United States Patent [19]

Schauble

[11] Patent Number: 4,473,811

[45] Date of Patent: Sep. 25, 1984

[54] SINGLE BOBBIN TRANSFORMER HAVING MULTIPLE DELINK WINDINGS AND METHOD OF MAKING SAME

[75] Inventor: George L. Schauble, El Paso, Tex.

[73] Assignee: General Instrument Corporation, New York, N.Y.

[21] Appl. No.: 352,226

[22] Filed: Feb. 25, 1982

[51] Int. Cl.[3] ..... H01F 27/28

[52] U.S. Cl. ..... 336/171; 29/605; 336/181; 336/221

[58] Field of Search ..... 336/171, 181, 183, 180, 336/182, 220, 221; 29/602 R, 605, 606

[56] References Cited

U.S. PATENT DOCUMENTS

| | | | |
|---|---|---|---|
| 1,575,552 | 3/1926 | Dow | 336/181 |
| 1,666,518 | 4/1928 | Vreeland | 336/171 X |
| 1,682,874 | 9/1928 | Vreeland | 336/181 X |
| 1,732,937 | 10/1929 | Jones | 336/181 |
| 1,775,880 | 9/1930 | Whitlock | 336/171 |
| 2,568,587 | 9/1951 | Macgeorge | 336/183 X |
| 2,837,697 | 6/1958 | Berger | 315/138 |
| 2,905,915 | 9/1959 | Harris | 336/181 |
| 3,753,189 | 8/1973 | Allen | 336/171 |
| 4,166,264 | 8/1979 | Starr | 336/181 X |

*Primary Examiner*—Thomas J. Kozma
*Attorney, Agent, or Firm*—Barry R. Lipsitz

[57] ABSTRACT

A symmetrically wound signal transformer having a first primary coil portion wound in one groove on a bobbin and a first secondary coil portion wound in an adjacent groove on the bobbin. A second primary coil portion, of shorter length than the first primary coil portion is wound in a reverse direction in the groove containing the first secondary coil portion. Likewise, a shorter second secondary coil portion is wound in a reverse direction in the groove containing the first primary coil portion. The respective second coil portions serve as decoupling windings.

13 Claims, 3 Drawing Figures

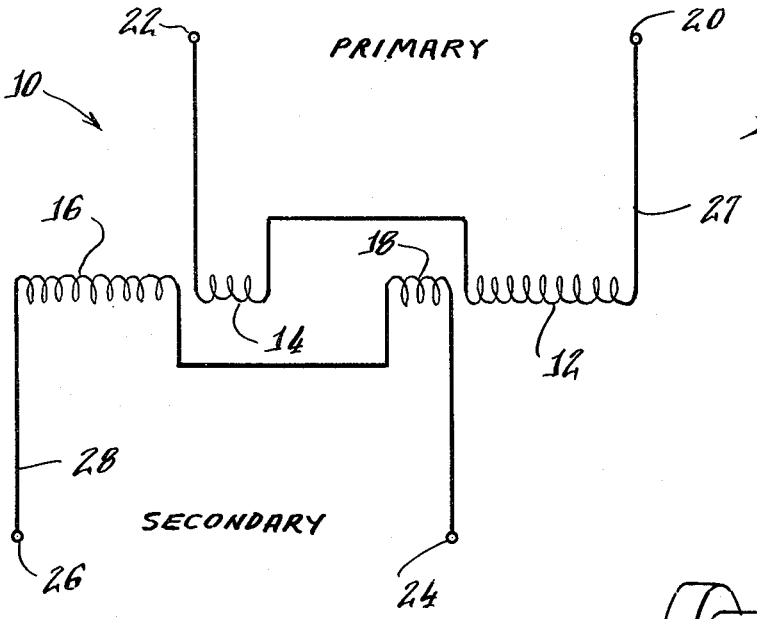
Fig. 1.
Fig. 2.
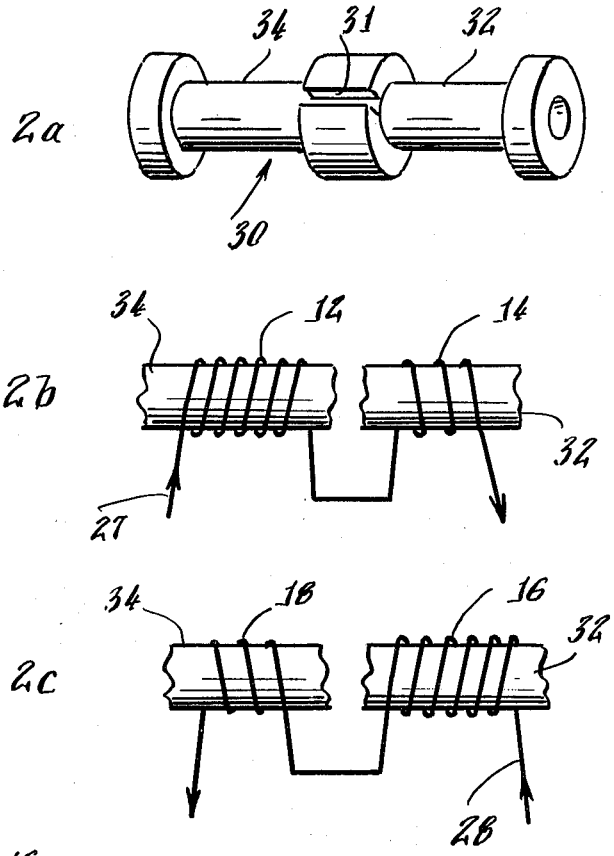
Fig. 3.
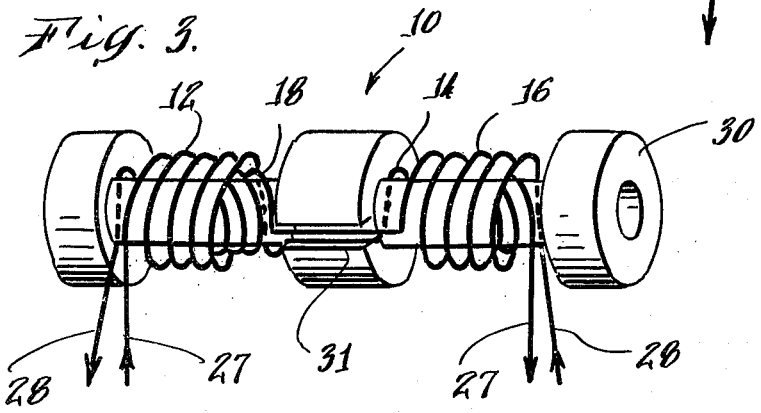

SINGLE BOBBIN TRANSFORMER HAVING MULTIPLE DELINK WINDINGS AND METHOD OF MAKING SAME

BACKGROUND OF THE INVENTION

The present invention relates to signal transformers and more particularly to a single bobbin transformer having multiple delink windings for controlling magnetic coupling.

Signal transformers are magnetic devices which are used in electric circuits. Such transformers have two or more coils which are wound on a core made from a magnetic material, typically iron. When an electric current is connected to one such coil, a magnetic field is produced which interacts with the other coils on the transformer core. If the magnetic field is time-varying, a voltage will be induced across the other coil or coils. Similarly, a time-varying current in the second coil will give rise to a voltage across the first coil. This mutual interaction between two coils is described by the term mutual inductance. In a transformer with two coils, one is known as the primary winding and the other as the secondary winding.

Signal transformers are used in various applications, including as component parts in televisions, radios, and other communication devices. For example, such transformers are useful in circuits which drive the audio-output (e.g., loud-speaker) in television sets and radios. Other signal transformers, known as Intermediate Frequency ("IF") transformers, are used in the signal processing circuitry of radios and televisions. Radio Frequency ("RF") transformers are used in the tuning stages of radios and televisions.

In designing signal transformers, various electrical parameters must be considered, such as the inductance of each coil, the mutual inductance between the coils, the currents, voltages, and frequencies at which the transformer will be operating, and the efficiency of the transformer. The present invention relates to the aspect of transformer design dealing with the control of the "coupling factor", or mutual inductance between multiple windings in a miniature signal transformer.

In past signal transformer designs, control of mutual inductance has been achieved by varying the space between the windings on the transformer core. As a result, the physical size of a given transformer designed to have a small mutual inductance could end up quite large, with respect to a similar transformer having a larger mutual inductance.

The practice of controlling the amount of coupling by varying the space between transformer windings necessitates the use of different size cores or bobbins, for different transformers. A large inventory of such bobbins must therefore be maintained by a transformer manufacturer. The use of different size bobbins also requires adjustments to be made to the transformer winding machinery, to accomodate the different bobbins.

It would be advantageous to provide a signal transformer design wherein the inductive coupling between transformer coils can be controlled by a method other than variations in the spacing of the coils with respect to each other. Such a transformer should enable the size of the transformer to be minimized while allowing electronic factors such as Q (efficiency) and K (inductive coupling) to be optimized. Further, it would be advantageous to provide a method of winding such a transformer where the primary and secondary coils can be wound simultaneously, resulting in a decrease in the time required to manufacture the transformer.

The present invention relates to such a transformer and the method of making it.

SUMMARY OF THE INVENTION

The present invention provides a miniaturized transformer comprising a bobbin having first and second adjacent grooves. The manner in which the primary and secondary windings are wound in the first and second grooves determines the mutual inductance of the transformer. Specifically, a continuous primary winding has a first primary coil portion wound in one direction in the first groove on the bobbin. The primary winding has a second primary coil portion, which is of shorter length than the first primary coil portion, and is wound in an opposite direction in the second groove on the bobbin. A continuous secondary winding has a first secondary coil portion which is wound in one direction in the second groove of the bobbin. A second secondary coil portion, of shorter length than the first secondary coil portion, is wound in an opposite direction in the first groove.

The number of turns in the first coil portions determine the inductance (and other related parameters) of the primary and secondary coils. The number of turns in the second coil portions is chosen to provide a desired amount of decoupling between the primary and secondary coils (first coil portions). This decoupling compensates for the maximum, normally excess coupling caused by the single bobbin on which the transformer is wound.

The transformer can be made by simultaneously winding, in one direction, the first primary coil portion in the first groove and the first secondary coil portion in the second groove. After the first coil portions have been wound, the respective wires at their terminal ends are moved, from the grooves they are in, to the opposite grooves. The winding direction is then reversed and, simultaneously, a second primary coil portion is wound in the second groove while a second secondary coil portion is wound in the first groove.

BRIEF DESCRIPTION OF THE DRAWINGS

Further objects and advantages will become apparent from the following description and claims, and from the accompanying drawings, wherein:

FIG. 1 is a schematic diagram of the transformer of the present invention;

FIG. 2 is a diagram showing how a transformer can be wound in accordance with the present invention; and FIG. 3 is an isometric view of a transformer manufactured in accordance with the present invention.

DETAILED DESCRIPTION OF THE INVENTION

The transformer of the present invention is a miniature signal transformer having a pair of symmetrical primary and secondary windings and a pair of symmetrical decoupling windings. The decoupling winding associated with the primary coil is a continuation of the secondary coil which is wound on the primary coil in a direction opposite to that in which the secondary coil is wound. Likewise, the decoupling winding for the secondary coil is a reverse-wound portion of the primary coil. This structure will be referred to hereinafter as "transverse reverse symmetry".

The general concept of transverse symmetry has been discussed in the transformer art. U.S. Pat. No. 2,837,697 entitled "Apparatus for Igniting and Operating Gaseous Discharge Devices" shows, in FIG. 2, a fluorescent lamp ballast where part of the primary is closely coupled to the second secondary winding and part of the second secondary winding is closely coupled to the primary winding. The patent uses this structure in order to *increase* coupling for the operation of fluorescent lamps at a typical frequency of 60 cycles AC. This patent does not disclose the use of transverse *reverse* symmetry wherein *decoupling* is provided by the reverse wound second coil portions. Further, the patent is not concerned with signal transformers for use in the audio to RF frequency range (e.g., 19 kilohertz to 108 megahertz) at low voltages (e.g., below 50 volts). Thus, the ballast disclosed in the patent is quite different from the transformer design of the present invention.

Turning now to FIG. 1 of the present drawings, a transformer 10, fabricated in accordance with the invention is schematically shown. A primary coil, across primary terminals 20 and 22, comprises a first primary coil portion 12 and a second primary coil portion 14. Coil portions 12 and 14 are wound from a single, continuous supply of wire 27. Second coil portion 14 is of shorter length, i.e. has a fewer number of turns, than first coil portion 12. Further, second coil portion 14 is wound in a direction opposite to that in which first coil portion 12 is wound.

Transformer 10 also has a secondary coil across secondary terminals 24 and 26. The secondary comprises a first secondary coil portion 16 and a second secondary coil portion 18. Second secondary coil portion 18 is adjacent first primary coil portion 12 and is shorter in length than first secondary coil portion 16. Second secondary coil portion 18 is also wound in the opposite direction than that in which first secondary coil portion 16 is wound. Second primary coil portion 14 is wound adjacent to first secondary coil portion 16.

Transformer 10 is wound on a single bobbin having two grooves. Such a bobbin is shown in FIG. 2*a*, wherein bobbin 30 includes adjacent grooves 32 and 34. The bobbin is preferably constructed of a magnetic material such as ferrite or powdered iron. In an alternate embodiment, bobbin 30 could be manufactured from a nonmagnetic material such as plastic, having a hollow core. A magnetic material could then be inserted into the hollow core of bobbin 30, providing the necessary magnetic properties to the overall assembly. Bobbin 30 also has a passageway 31 cut therein. Passageway 31 provides a crossover point for the wire from first primary coil portion 12 to second primary coil portion 14. Passageway 31 also provides a crossover point for the wire from first secondary coil portion 16 to second secondary coil portion 18.

The winding of transformer 10 can best be understood by referring to FIG. 2. As shown in FIG. 2*a*, bobbin 30 is initially empty. FIG. 2*b* shows how the primary windings are made in grooves 34 and 32. FIG. 2*c* shows how the secondary windings are made in grooves 32 and 34. The winding of both the primary and secondary coils can be done simultaneously. The steps have been separated in FIGS. 2*b* and 2*c* merely for convenience in describing the simultaneous operation.

Referring to FIG. 2*b*, wire 27 is shown wrapped around groove 34 to form first primary coil portion 12. Wire 27 then continues (through passageway 31 shown in FIG. 2*a*) to groove 32 where the winding direction is reversed so that secondary primary coil portion 14 can be wound.

FIG. 2*c* shows the winding of the secondary coil portions. Wire 28 is first wound in groove 32 to form first secondary coil portion 16. Wire 28 is then transferred to groove 34 (through passageway 31) so that it can be wound in the reverse direction to form second secondary coil portion 18.

After first primary coil portion 12 has been wound in groove 34, cement can be applied to wire 27 before it is transferred to groove 32 in order to secure the terminal end of first primary coil portion 12 in groove 34. After second primary coil portion 14 is wound in groove 32, cement can be applied at the terminal end thereof to secure the coil in groove 32. Cement can be applied in a similar manner to the terminal ends of first secondary coil portion 16 and second secondary coil portion 18.

A finished transformer manufactured in accordance with the present invention is shown in FIG. 3.

The number of turns of second primary coil portion 14 will typically be on the order of 10% of the number of turns in first primary coil portion 12. Similarly, the number of turns in second secondary coil portion 18 will typically be on the order of 10% of the number of turns in first secondary coil portion 16. The 10% ratio will be varied depending on the amount of decoupling which is desired between the first primary and secondary portions. In practice, the length of each second coil portion can be within the range of about 5% to 20% of the length of its respective first coil portion. Further, in order to provide equal parameters in both the primary and secondary coils, the number of turns in each first coil portion may be equal and the number of turns in each secondary coil portion may be equal. In this instance, a perfectly symmetrical transformer would result.

The operation of the transformer of the present invention will now be described.

First primary coil portion 12 has a self-inductance which can be referred to as La. Similarly, first secondary coil portion 16 has a self-inductance which can be referred to as Lb. When energized, first primary coil portion 12 creates a magnetic field which interacts with first secondary coil portion 16. Second primary coil portion 14, however, being wound in a reverse direction, cancels a portion of the effect which La has on Lb. This results in a reduced mutual inductance between La and Lb.

In the same manner, second secondary coil portion 18 cancels a portion of the magnetic field imposed by Lb on La. This results in a reduction of the mutual inductance between Lb and La.

Due to the symmetry of the present transformer, external factors affecting the operation of the device will tend to be cancelled out. Thus, a stable product is obtained which will have very predictable electrical parameters. Tuning cups can be added to the present transformer in a conventional manner to provide for tuning changes. Again, due to the symmetry of the device, the mutual inductance between the primary and secondary windings will remain relatively constant throughout such tuning changes.

While only a single embodiment has been described herein for purposes of illustration, it will be appreciated by those skilled in the art that other variations and modifications could be made thereto. For example, the transformer can be wound on any type of coil form, not limited to a bobbin. It is intended to cover all of the variations and modifications which fall within the scope of the present invention, as recited in the following claims:

I claim:

1. A miniaturized signal transformer comprising:

a coil form;

a continuous primary winding having a first primary coil portion wound in one direction in a first area of said coil form and a second primary coil portion, of fewer turns than said first primary coil portion, wound in an opposite direction in a second area of said coil form adjacent said first area; and a continuous secondary winding having a first secondary coil portion wound in one direction in said second area concentric with said second primary coil portion, and a second secondary coil portion, of fewer turns than said first secondary coil portion, wound in an opposite direction in said first area concentric with said first primary coil portion.

2. The transformer of claim 1 further comprising a tuning element, fabricated from a magnetic material, operatively associated with said transformer.

3. The transformer of claim 1 wherein said first primary coil portion and said first secondary coil portion comprise the same number of turns.

4. The transformer of claim 1 or 3 wherein said second primary coil portion and said second secondary coil portion comprise the same number of turns.

5. The transformer of claim 1 wherein said first primary coil portion and said first secondary coil portion are wound in the same direction on said coil form.

6. The transformer of claim 1 wherein the length of each second coil portion is within the range of from about 5% to 20% of the length of its respective first coil portion.

7. The transformer of claim 1 wherein said coil form comprises a bobbin, said first area of said coil form comprises a first groove in said bobbin, and said second area of said coil form comprises a second groove in said bobbin.

8. The transformer of claim 7 wherein said bobbin comprises a magnetic material.

9. The transformer of claim 7 further comprising means in said bobbin between said first and second grooves for providing a passage through which the transitions between said respective first and second coil portions can be made.

10. A method of making a transformer comprising the steps of:

winding, in one direction, a first primary coil portion in a first area of a coil form;

winding, in the opposite direction, a second primary coil portion of fewer turns than said first primary coil portion, continued from said first primary coil portion, in a second area of said coil form adjacent said first area;

winding, simultaneously with and in the same direction as the winding of said first primary coil portion, a first secondary coil portion in said second area; and winding, simultaneously with and in the same direction as the winding of said second primary coil portion, a second secondary coil portion of fewer turns than said first secondary coil portion, continued from said first secondary coil portion, in said first area.

11. The method of claim 10 further comprising the steps of applying a wire bonding cement to the terminal ends of said first coil portions prior to beginning the winding of said second coil portions.

12. The method of claim 10 wherein said second coil portions are wound such that each has a length within the range of about 5% to 20% of the length of its respective first coil portion.

13. The method of claim 10 wherein said coil form comprises a bobbin, said first area of said coil form comprises a first groove in said bobbin, and said second area of said coil form comprises a second groove in said bobbin.

* * * * *